United States Patent [19]

Moore et al.

[11] Patent Number: 4,561,240

[45] Date of Patent: Dec. 31, 1985

[54] APPARATUS FOR RETRIEVING OBJECTS FROM THE GROUND

[75] Inventors: Joseph L. Moore, Abilene; R. Keith Moore, Midland; Dennis K. Moore, Richardson, all of Tex.

[73] Assignee: Proficient Systems, Inc., Richardson, Tex.

[21] Appl. No.: 531,304

[22] Filed: Sep. 9, 1983

[51] Int. Cl.[4] ..... A01D 46/00; E01H 1/04

[52] U.S. Cl. ..... 56/328 R; 15/3; 15/84

[58] Field of Search ..... 134/6; 15/83, 84, 3; 56/327 R, 328 R

[56] References Cited

U.S. PATENT DOCUMENTS

| | | | |
|---|---|---|---|
| 667,580 | 2/1901 | Rogers . | |
| 1,035,613 | 8/1912 | Lint . | |
| 1,859,980 | 5/1932 | Mueller . | |
| 1,879,905 | 9/1932 | Liebfried . | |
| 2,298,145 | 10/1942 | Merrylees . | |
| 2,539,596 | 1/1951 | Smith . | |
| 2,599,715 | 6/1952 | Lepper . | |
| 2,642,306 | 6/1953 | Beeler . | |
| 2,666,665 | 1/1954 | Whitcher et al. . | |
| 2,694,284 | 11/1954 | Kortz . | |
| 2,792,253 | 5/1957 | Bliss . | |
| 2,804,336 | 8/1957 | Thompson . | |
| 2,928,225 | 3/1960 | Spencer . | |
| 3,362,480 | 1/1968 | Barber . | |
| 3,451,488 | 6/1969 | Taketa . | |
| 3,483,687 | 12/1969 | Tanner, Jr. . | |
| 3,534,535 | 10/1970 | Reynolds et al. . | |
| 3,712,039 | 1/1973 | Avis . | |
| 3,712,660 | 1/1973 | Moore . | |
| 3,739,855 | 6/1973 | Bliss . | |
| 3,807,154 | 4/1974 | Moore . | |
| 3,849,824 | 11/1974 | Doering | 15/83 |
| 3,888,370 | 6/1975 | Gamblin . | |
| 3,923,101 | 12/1975 | Donohue . | |
| 3,990,125 | 11/1976 | Saiia | 15/83 X |
| 3,993,141 | 11/1976 | Donohue . | |
| 3,999,316 | 12/1976 | Palmer | 15/83 X |
| 4,434,011 | 2/1984 | Moore | 134/6 |

*Primary Examiner*—Marc L. Caroff

*Attorney, Agent, or Firm*—Litman, Day and McMahon

[57] ABSTRACT

An apparatus for collecting flat or semiflat materials while simultaneously retrieving bottles and cans includes a ground engageable rotating drum (50) with a plurality of fingers (80) extending radially from the drum. A spring finger assembly (100) cooperates with the drum (50) to retrieve articles from the ground. The spring finger assembly includes an upper and lower unit (104, 102) each including a plurality of spring fingers (128) mounted on a rotary shaft assembly (116, 118, 122) driven in conjunction with the rotation of the drum. The rotary shaft assembly and the spring fingers attached thereto rotate with respect to fixed stripper plates (140). A camming device (122, 130, 132) acts to rotate and extend the fingers beyond the stripper plates when the fingers move adjacent to the drum fingers and to rotate and withdraw the spring fingers behind the stripper plates upon further rotation such that the material engaged by the spring fingers is stripped therefrom.

9 Claims, 7 Drawing Figures

FIG. 7
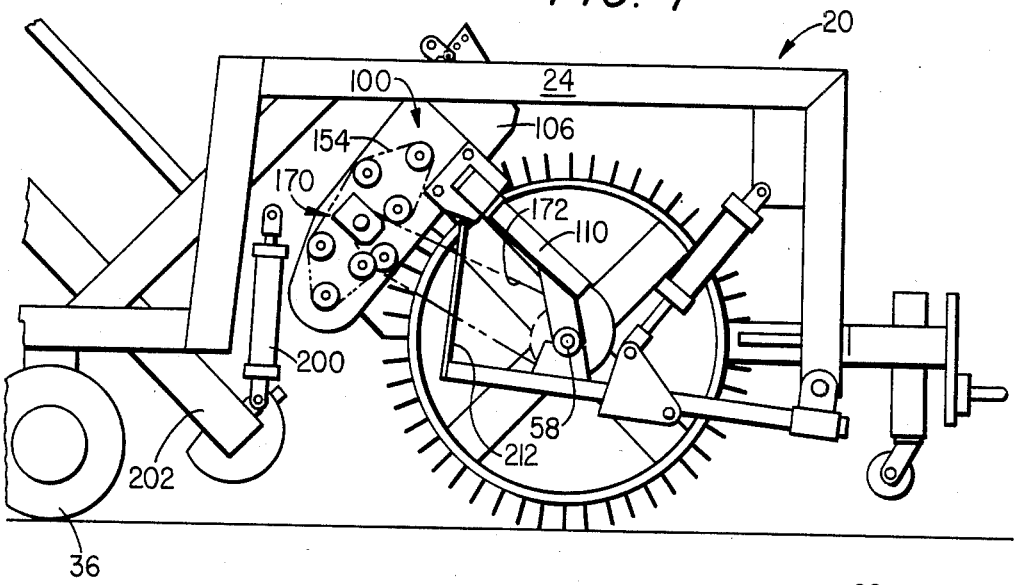
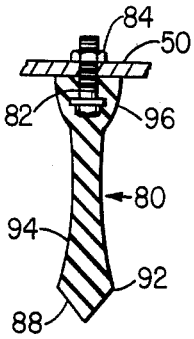
FIG. 3
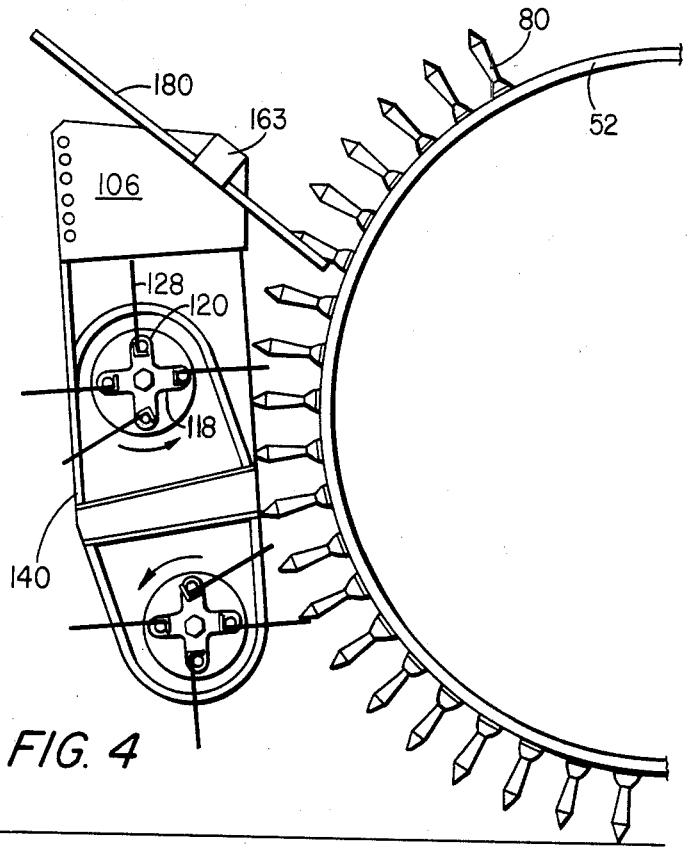
FIG. 4

APPARATUS FOR RETRIEVING OBJECTS FROM THE GROUND

TECHNICAL FIELD

The present invention relates to a method and apparatus for retrieving and collecting objects from the ground, and more particularly for such a method and apparatus used in litter retrieval.

BACKGROUND ART

Many man-hours are expended in the collection of litter and other debris from large community areas such as along streets and highways, parks, playgrounds, along beach areas and open commercial areas. Because of the difficulty of designing a machine which will collect the various types and sizes of litter and operate over various types of ground surfaces, manual retrieval has often been relied on. However, manual retrieval methods are slow and many times are ineffective, particularly where large areas must be patrolled.

Machines have been designed to supplement or replace the need for manual retrieval of litter. An effective apparatus for litter retrieval is disclosed in U.S. Pat. No. 3,807,154, to Joseph L. Moore, issued Apr. 30, 1974, assigned to the assignee of this application. This patent discloses the use of a towed apparatus having a rotatable drum which is rotated upon ground engagement. A plurality of flexible fingers extends radially from the drum and has a particular configuration for receiving bottles and cans therebetween during the movement of the apparatus along the ground surfaces. Bottles, cans and similar objects engaged by the drum and fingers are collected in a hopper after being stripped from the fingers. Although the device described in U.S. Pat. No. 3,807,154 is capable of retrieving some objects, such as bottles and cans, the effectiveness of the device has been less than completely satisfactory for other types of litter. Where the particular object cannot be grabbed between the resilient fingers extending from the drum, then the apparatus may fail to collect the debris.

An effective litter retrieving apparatus is also disclosed in U.S. application Ser. No. 358,382, filed Mar. 15, 1982, now U.S. Pat. No. 4,434,011, by Joseph L. Moore and assigned to the assignee of this application, such application being incorporated herein by reference. This apparatus includes a rotatable ground engaging drum action with cooperating discs for collecting litter from the ground and directing such litter to a collection station.

It is critical that an apparatus for collecting litter be able to retrieve bottles, cans and objects having arcuate outer surfaces of a form retaining nature, as well as simultaneously collecting materials such as paper, and various containers made thereof, textile materials and other flat or semiflat objects. Thus, the need exists for devices which can simultaneously collect both bottles and cans, which make up a large portion of the litter in large public and private areas, as well as other debris of differing shapes and materials. Further, the devices must provide for a method and apparatus which is capable of picking up various types of debris while being able to remove such debris from the pickup structure so that the debris may be conveyed to a collection area.

Apparatus with respect to these types of devices must also properly disclose a means for supporting the weight of the drum and finger assembly without sustaining damage to the fingers. Such support must not permit an excessive "dead space" which is not engaged by the fingers where the device encounters irregular terrain.

DISCLOSURE OF THE INVENTION

The present invention provides an improved method and apparatus for collecting flat or semiflat materials such as various paper, textile materials and the like, while simultaneously retrieving bottles and cans and other objects having cylindrical form retaining outer structures. In accordance with one embodiment of the invention, the apparatus has a ground engageable rotating drum with a plurality of fingers extending radially from the drum. A first rotary means is mounted relative to and rotates in conjunction with the drum in a direction opposite that of the drum. The rotary means is positioned adjacent the drum and at ground level during operation of the retrieval apparatus. The rotary means is positioned behind the drum in relation to the direction of travel of the drum and assists in engagement and movement of objects by the drum and the drum fingers to a collection location.

In accordance with the present invention, the rotary means includes a plurality of spring fingers mounted on a rotary shaft assembly driven in conjunction with the rotation of the drum. In the preferred arrangement, the rotary shaft assembly includes four longitudinal bars having a plurality of spring fingers attached along their length with each bar moved in a circular path and the angle of the bar being controlled by a cam attached thereto. The rotary shaft assembly and the spring fingers attached thereto rotate with respect to fixed stripper plates. The camming device acts to extend the spring fingers beyond the stripper plates when the fingers move adjacent to the drum fingers and to rotate and withdraw the spring fingers behind the stripper plates upon further rotation such that the material engaged by the spring fingers is stripped therefrom.

The drum fingers are attached in rows positioned along the length of the drum and the spring fingers are positioned such that they pass intermediate of the rows of drum fingers. A second rotary means, substantially identical to that of the first rotary structure, is positioned above the first rotary structure and rotates in conjunction with the rotation of the drum in a direction opposite that of the drum. This structure also includes a plurality of spring fingers spaced along the length of the drum positioned intermediate of the drum fingers. The spring fingers of the second rotary means act to disengage objects from the drum fingers and direct such objects to a conveyor for movement to a collection station. Additionally, a plurality of kicker bars are positioned above the second rotary means with the ends thereof between the drum fingers from dislodging objects from the drum fingers as the drum is rotated. These objects are directed to the upper rotary means which directs the object to a conveyor for removal to a collection area.

In accordance with still another embodiment of the invention, an annular ring of rigid material is positioned in place of one of the rows of fingers approximately one quarter the length of the drum from each end. These two annular rigid rings are approximately the height of the resilient and flexible fingers and provide support to the weight of the drum as the drum traverses the ground surface.

In accordance with one of the methods of the present invention, objects are retrieved from the ground by moving a ground engageable drum with a plurality of fingers extending therefrom over the ground surface for contacting the objects therebetween. A first rotary means is positioned adjacent the drum and fingers and rotates in conjunction with the rotation of the drum in a direction opposite that of the drum. The first rotary means is positioned at ground level during operation of the retrieving means and assist in engaging and movement of the objects by the drum and the drum fingers to a collection location. The objects are stripped from engagement between the fingers of the drum at an elevated position and are collected for later disposal. Removal of objects from the drum as the drum rotates is facilitated by the use of a second rotary means, positioned above the first rotary means, which is rotated in conjunction with the rotation of the drum in a direction opposite that of the drum. The rotary means engages the objects collected between the drum fingers and carries them away from the drum to a conveyor for movement to a collection location.

BRIEF DESCRIPTION OF THE DRAWINGS

For a more complete understanding of the present invention, and for further details and advantages thereof, reference is now made to the following Detailed Description, taken in conjunction with the accompanying Drawings, in which:

FIG. 3 is a section view of one of the drum fingers of the present invention;

FIG. 4 is a side view of the finger assembly in the invention;

FIG. 7 is a side view of the invention showing the spring finger assembly in a partially raised position.

DETAILED DESCRIPTION

Figure 1:
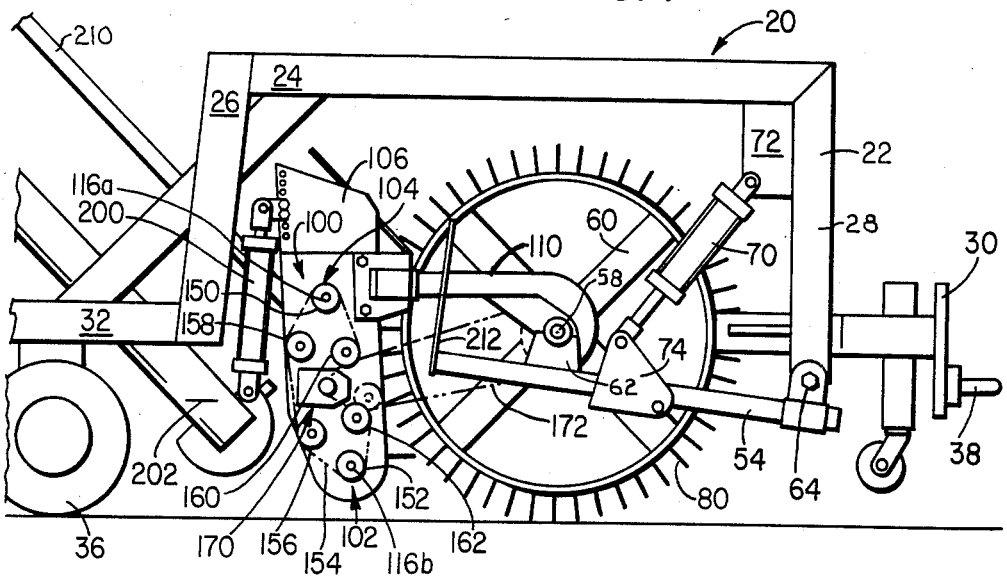
FIG. 1 is a side view of the apparatus of the present invention with the outer structure partially removed to reveal the inner components thereof.

FIGS. 1–7 illustrate the present invention which incorporates a novel design for cooperating with a rotatable drum assembly to retrieve litter and other objects from the ground and deposit such objects in a collection hopper. Referring to FIG. 1 in conjunction with FIG. 2, apparatus 20 of the present invention includes a frame 22 having an upper horizontal beam structure 24 with vertical frame members 26 and 28 extending downwardly therefrom. A tongue assembly 30 extends forwardly from vertical frame members 28 and a horizontal tail beam 32 extends rearwardly from vertical frame member 26. A material collection hopper, not shown, is supported on tail beam 32 and a wheel assembly 36 is mounted below the frame structure beneath the collection hopper. A coupler 38 is attached to tongue assembly 30 for attachement to a truck or tractor in the usual manner.

The structure for retrieving objects from the ground includes a rotatable drum assembly 50 consisting of a drum 52 pivotally supported from frame 22 by arms 54. Drum 52 includes a cylindrical wall 56 with a central axle 58 supported from the wall 56 at the rotational center by a plurality of arms 60. Axle 58 is supported on arms 54 by an appropriate pillow block 62. The opposite end of arm 54 is hingedly attached by an appropriate lug and pin assembly 64 at the lower end of frame member 28. A hydraulic cylinder 70 is connected between frame 22 at a support plate 72 and at arm 54 by a plate 74. By extending or retracting cylinder 70, arm 54 may be lowered or raised, respectively, to lower and raise drum assembly 50 relative to frame 22.

Drum assembly 50 includes a pluarlity of receiving fingers 80 attached to and extending radially from drum cylinder 52. Fingers 80 are equally spaced in rows along the length of drum 52.

FIG. 3 illustrates a section view of one of the fingers 80. The finger includes a metallic base shaft 82 which is attached through the sidewall 56 of drum 52 using a nut 84 on the inside surface. The end of shaft 82 is threaded to receive nut 84 thereon. A shoulder on the end of shaft 82, larger than the aperture through the sidewall of drum 52, permits the mounting of the fingers as shown in FIG. 3. A specially shaped body portion 86 is attached on the end of shaft 82. Body portion 86 is preferably formed of a resilient material, such as neoprene. The body portion includes a conically shaped lower end 88 forming a camming surface 90 with a maximum diameter at 92 and having an arcuate longitudinally extending concave article holding surface 94 extending to the radially inwardly end of the body portion and terminating in a circular rim at 96 of a diameter less than that of the lower end at 92 but greater than that of the central region of the article holding surface. It will be seen that no portion of the article holding surface 94 has a diameter greater than the diameter at 92.

Figure 2:
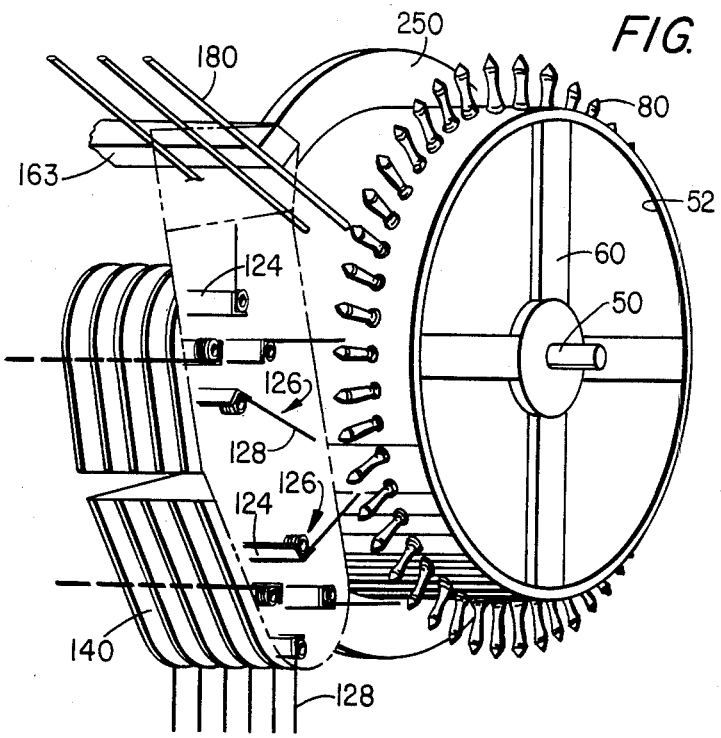
FIG. 2 is a perspective view of the drum assembly, the spring finger assembly and kicker bars of the present invention.

Referring still to FIG. 1 in conjunction with FIGS. 2 and 4, a spring finger assembly 100 is mounted to the rear of drum assembly 50 and cooperates with drum assembly 50 to collect objects from the ground, carry them upwardly with the rotation of drum assembly 50 and direct them to the collection hopper. Spring finger assembly 100 includes a lower assembly unit or feed member 102 and an upper assembly unit or feed member 104 mounted on a mounting mechanism between a pair of side plates, the near side plate 106 being shown in FIG. 1. The unit pivots on an arc corresponding to the curvature of drum assembly 50 by virtue of pivotal movement about axle 58 by way of arms 110. As can be seen in FIG. 1, arm 110 is connected at one end to plate 106 by an appropriate fitting, with the other end attached for pivotal movement using an appropriate fitting to axle 58 of drum assembly 50.

Figure 5:
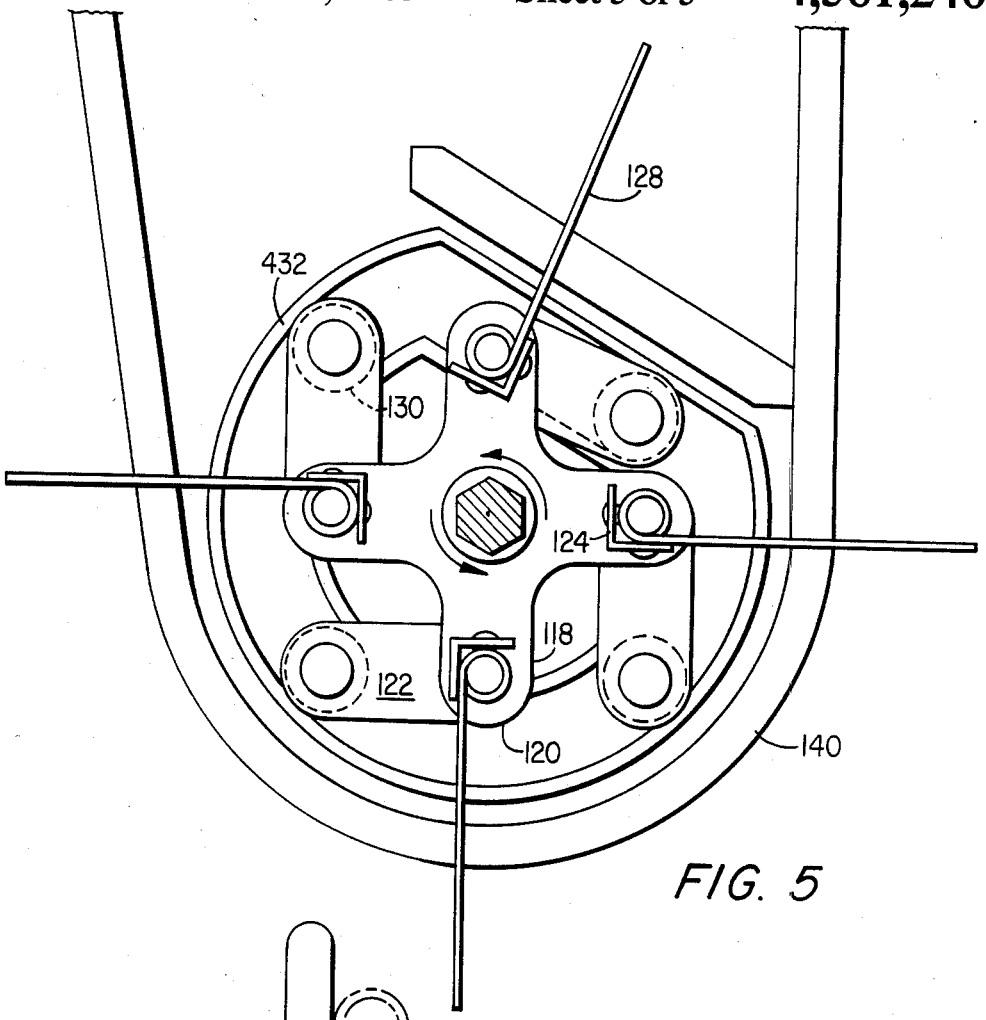
FIG. 5 is an enlarged vertical section view of the lower portion of the spring finger assembly of the invention.

Referring to FIG. 2 in conjunction with FIG. 4, spring finger assembly 100 includes substantially identical lower and upper assembly units 102 and 104. These units include a rotatable member or rotating shaft 116 supporting a spider 118 on each end thereof. Spiders 118 have apertures 120 at the outer ends of each spider finger for receiving the pin end of a follower cam arm 122. A spring finger support bar 124 is attached between corresponding pin ends of the cam follower arm and has a plurality of spring finger assemblies 126 attached thereto by appropriate bolts. Spring finger assemblies 126 each have a spring fingers 128 attached thereto. A cam following bearing 130 is attached to each cam follower arm and moves in a cam 132 as shaft 116 is rotated. As can be seen in FIG. 5, cam 132 has a flat side which causes support bar 124 to rotate on its axis as the cam follower engages the flat surface to rotate the spring finger assemblies as is known in the art.

FIG. 2 illustrates the spring finger assembly 100 assembled with stripper plates 140 mounted thereon. As can be seen, the present invention incorporates back to back lower and upper assembly units 102 and 104 with a slight arc to position the upper and lower units in closer proximity to the drum assembly. As is shown in FIG. 1, the shaft 116*a* of the upper assembly and shaft 116*b* of the lower assembly protrude through side plate 106 and are fitted with sprockets 150 and 152, respectively. A chain 154 is engaged around sprockets 150 and 152 and about idler sprockets 156, 158, 160 and 162. Chain 154 also is engaged around a dual sprocket idler 170 which is driven by a drive means including a chain 172 engaged around an appropriate drive sprocket which rotates with drum assembly 50. As a result of the particular positioning of chain 154, the rotation of spring finger assembly shafts 116*a* and 116*b* are driven in a direction opposite that of the rotation of drum assembly 50.

As is also seen in FIGS. 1 and 2, kicker bars 180 are positioned on a support bar 163 between side plates 106 and are aligned intermediate of the rows of drum fingers 80. These kicker bars have their ends positioned in close proximity to the drum cylindrical wall 56 and facilitate the removal of objects engaged between the drum fingers in the event the spring finger assemblies do not dislodge such material.

The spring finger upper and lower assemblies are positioned such that the spring fingers 128 are also aligned between the rows of drum fingers. In operation of the unit, these spring fingers are rotated with the spring finger assemblies in a direction opposite the rotation of drum assembly 50. Lower assembly unit 102 is positioned adjacent to the ground surface during operation but adjustment of such position is readily accomplished by the extension or retraction of hydraulic cylinder 200 connected between side plate 106 and a conveyor frame member 202 which is fixedly attached relative to the frame 22. Similarly, upper assembly unit 104 is positioned immediately above lower assembly unit 102 and also is aligned such that the spring fingers are intermediate of drum fingers 80.

During operation of the unit, arm 54 is free to pivot about its attachment to frame 22 such that drum assembly 50 engages the ground surface. Drum assembly 50 is rotated (clockwise as viewed in FIG. 1) upon movement of the unit over the ground surface with rotation of the drum assembly causing the rotation of both the lower and upper spring finger assemblies 102 and 104. This in turn causes the rotary movement of the individual spring fingers (in a counterclockwise direction as viewed in FIG. 1). The lower assembly unit 102, being positioned adjacent to the drum assembly and to the ground surface, operates to force objects into engagement with the drum fingers for movement upwardly as the drum assembly rotates.

As the spring fingers rotate, they move between and are rotated and retracted behind the strippers positioned on either side of the spring fingers thereby withdrawing any debris or objects engaged on or between the spring fingers. As the objects are moved upwardly by virtue of engagement between the drum fingers and the spring finger assembly, the upper spring fingers of the upper spring finger assembly 104 operate to dislodge such objects and to carry them rearwardly to a conveyor system 210 positioned rearwardly of the spring finger assembly. Conveyor assembly 210 then carries the objects to the collection hopper.

Figure 6:
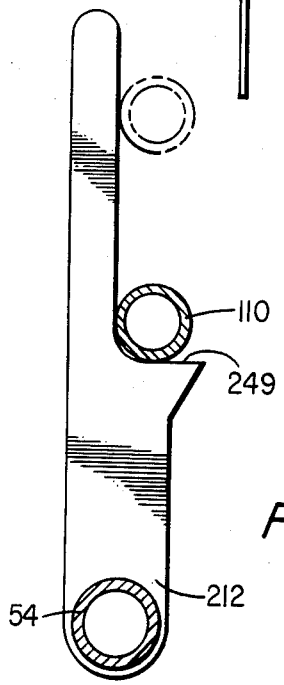
FIG. 6 is a section view taken along line 6—6 of FIG. 1.

Referring still to FIG. 1 in conjunction with FIG. 6, a lowermost position for spring finger assembly 100 relative to drum assembly 50 is defined by an arrest arm 212 which extends upwardly from the end of drum support arm 54. As can be seen in FIG. 7, arrest arm 212 has a landing 249 for receiving arm 110 where it is moved to the lowermost position shown in FIG. 1. Although adjustment may be provided by controlling the extension or retraction of spring finger assembly adjustment cylinder 200, the bottomed out position shown in FIG. 1 is that normally used during operation of the apparatus. It should also be noted that spring finger assembly 100 may be rotated to a position above drum assembly 50 by the extension of cylinder 200, or by disconnecting cylinder 200 and manually pivoting the spring finger assembly, to an upper position with arm 110 substantially vertical, that is in a position with the assembly rotated beyond that shown in FIG. 7. This places the spring finger assembly in a completely accessible and convenient position for cleaning or repairing the assembly.

It has been found that the litter retrieval apparatus disclosed in FIGS. 1–7 provides a system which permits numerous adjustments between the spring finger assembly and the drum assembly while providing an optimum arrangement for collecting litter and other objects from the ground surface. The apparatus also provides a structure which readily sheds such material from all components, including the spring finger assembly and the drum assembly, for collection and later disposal. Thus, where other devices have encountered problems with both the retrieval of objects from the ground surface and the shedding of such objects once they have been grasped by the apparatus, the present invention accomplishes both.

In the other devices, a positive means of lifting various sizes of paper and other products other than bottles and cans has not been effectively provided. However, the present invention provides finger assembly 100 for this purpose. As the apparatus traverses the ground surface, spring finger assembly unit 102 acts to lift paper and other litter into the area between the assembly and the ends of fingers 80. As a result of the counterrotation of these two components, paper and other similar debris are carriedd upwardly above assembly unit 102. It will be appreciated that it is not necessary that the paper or other debris be spiked by the fingers but rather the material may merely be conveyed upwardly as a result of the entrapment between spring fingers 128 and fingers 80. Of course, some paper may be spiked by fingers 80 or fingers 128 which would provide even more positive transmission of the litter upwardly as the drum rotates.

At the upper point of their movement, bottles and cans and other debris which are grasped by fingers 80 are stripped therefrom upon engagement of upper asembly unit 104 and kicker bars 180. These units direct the debris rearwardly where it is picked up by conveyor assembly 210 and carried upwardly into a collection hopper for later disposal.

Thus, apparatus 20 provides a structure for not only positively collecting bottles and cans, but also a structure which simultaneously provides a very effective means for directing other debris of virtually all sizes and material upwardly with the movement of drum assembly 50 and thereafter onto a conveyor for disposal into a collection hopper.

Because the drum assembly of the present invention engages the ground as it rotates, substantial load is placed upon the fingers to support the weight of the apparatus during operation.

A structure for supporting the weight of the drum assembly is shown in FIG. 2. In this embodiment, an annular ring 250 of rigid material is positioned in place of one of the rows of fingers approximately one quarter of the length of the drum from each end. These two annular rigid rings are approximately the height of the resilient and flexible drum fingers and provide support to the weight of the drum as the drum traverses the ground surface.

While the apparatus in the present invention has been described as used in the retrieval of litter, it has been found that the machine is ideally suited for collecting agricultural products from the ground. For instance, the apparatus may be used in the retrieval of corn which has been knocked to the ground during combining operations or as a result of the weather.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

We claim:

1. In a device for retrieving objects from the ground, the device having a ground engageable rotatable drum mounted on an axle and having a plurality of drum fingers extending radially outwardly from said drum for engageably receiving the objects therebetween as said drum rotates in a first direction, the improvement comprising:

a. a first feed member having a first rotatable member, first drive means and a plurality of first spring fingers generally extending radially outwardly from said first rotatable member; said first drive means selectively rotating said first rotatable member;

b. a second feed member having a second rotatable member, second drive means, and a plurality of second spring fingers generally extending radially outwardly from said second rotatable member; said second drive means selectively rotating said second rotatable member;

c. an adjustable mounting mechanism having said first feed member and said second feed member mounted thereon;

(i) said second feed member being mounted substantially above said first feed member and being oriented for said second spring fingers to remove trapped objects from between said drum fingers and;

d. an adjustment mechanism having means for rotating said mounting mechanism about said drum axle to selectively position said first feed member with respect to the ground, and simultaneously adjust said second feed member to maintain a constant spacing between said second feed member and said first feed member while simultaneously maintaining a constant distance between said second feed member and the drum;

e. whereby said first feed member is selectively positionable to direct objects from the ground and into said drum fingers, and said second feed member is simultaneously selectively positionable to remove objects from said drum fingers and direct them toward a hopper.

2. The improved device according to claim 1 wherein:

a. said adjustable mounting mechanism includes first and second side plates with said first and second rotatable members extending therebetween; and b. said adjustment mechanism includes first and second pivotal arms and arm positioning means;

(i) said first and second pivotal arms being mounted to pivot about said drum axle and having said side plates mounted thereon with said first and second rotatable members extending therebetween and;

(ii) said arm positioning means selectively positioning said arms to orient said first feed member in a selected position relative to the ground.

3. The device according to claim 2 wherein:

a. said first spring fingers are selectively oriented, with respect to said drum fingers, to pass partially between said drum fingers, when said drum and said first rotatable member rotate, to sweep objects into said drum fingers.

4. The device according to claim 3 wherein:

a. said arm positioning means comprises an hydraulic cylinder and ram assembly.

5. The device according to claim 2 wherein:

a. said first fingers are long, narrow and have relatively sharp ends for spearing spearable objects and;

b. said first spring fingers are located on a trailing side of said drum, from a point of ground contact of the drum;

c. whereby said first spring fingers are positioned to spear or sweep objects, not initially engaged by said drum fingers, and direct said objects forwardly into said drum fingers.

6. The device according to claim 2 wherein:

a. said first and second drive means are powered by a drive mechanism actuated by rotation of said drum;

b. whereby rolling said drum over a ground surface provides power for rotating said first and second feed members.

7. The device according to claim 2 including:

a. first and second support rings positioned approximately one quarter of the length of the drum from each end thereof;

(i) said support rings extending radially from the drum and being substantially rigid and substantially equal in length to the drum fingers;

b. whereby a substantial portion of the weight of said drum is carried on said rings.

8. In a device for retrieving objects from the ground, the device having a ground engageable rotatable drum mounted on an axle and having a plurality of drum fingers extending radially outwardly from said drum for engageably receiving the objects therebetween as said drum rotates in a first direction, the improvement comprising:

a. a first feed member having a first rotatable member, first drive means, and a plurality of first spring members generally extending radially outwardly from said first rotatable member;

(i) said first drive means selectively rotating said first rotatable member;

(ii) said first spring fingers being long and narrow, with relatively sharp ends for spearing spearable objects;

(iii) said spring fingers being located on a trailing side of said drum, from a point of ground contact of said drum; said spring fingers being selectively oriented, with respect to said drum fingers, to pass partially between said drum fingers, when said drum and said first rotatable member rotate, to sweep objects into said drum fingers;

b. a second feed member having a second rotatable member, second drive means, and a plurality of second spring fingers generally extending radially outwardly from said rotatable member;

(i) said second drive means selectively rotating said second rotatable member;

c. an adjustable mounting mechanism having first and second side plates with said first and second feed members being mounted on said side plates and extending therebetween;

(i) said second feed member being mounted substantially above said first feed member, said second feed member being oriented for said second spring fingers to remove trapped objects from between said drum fingers and;

d. an adjustment mechanism having first and second pivotal arms and arm positioning means;

(i) said first and second pivotal arms being mounted to pivot about said drum axle;

(ii) said side plates being mounted on said pivotal arms, with said rotatable members extending therebetween;

(iii) said arm positioning means selectively positioning said arms with said first feed member substantially adjacent the ground and simultaneously adjusting said second feed member to maintain a constant spacing between said second feed member and said first feed member while simultaneously maintaining a constant distance between said second feed member and the drum;

e. whereby said first feed member is selectively positionable to direct objects from the ground and into said drum fingers, and said second feed member is simultaneously selectively positionable to remove objects from said drum fingers and direct them toward a hopper.

9. The device according to claim 8 wherein:

a. said first and second drive means are powered by a drive mechanism actuated by rotation of said drum;

b. the drum includes first and second support rings positioned approximately one quarter of the length of the drum from each end thereof;

(i) said support rings extending radially from the drum and being substantially rigid and substantially equal in length to the drum fingers;

c. whereby rolling said drum over a ground surface provides power for rotating said first and second rotatable members; and d. whereby a substantial portion of the weight of said drum is carried, during said rolling, on said rings.

* * * * *